US006276629B1

(12) United States Patent
Laporte

(10) Patent No.: US 6,276,629 B1
(45) Date of Patent: Aug. 21, 2001

(54) ROLL SUPPORT

(75) Inventor: Yvan Laporte, Longueuil (CA)

(73) Assignee: Experts en Traitement de l'Information (E.T.I.) Montreal Inc.

( * ) Notice: Subject to any disclaimer, the term of this patent is extended or adjusted under 35 U.S.C. 154(b) by 0 days.

(21) Appl. No.: 09/328,124

(22) Filed: Jun. 8, 1999

(30) Foreign Application Priority Data

May 20, 1999 (CA) ..... 2272765

(51) Int. Cl.[7] ..... B65H 16/06; B65H 19/12

(52) U.S. Cl. ..... 242/596.3; 242/596.4; 242/596.7

(58) Field of Search ..... 242/596.1, 596.3, 242/596.4, 596.7, 560, 560.3, 596.8

(56) References Cited

U.S. PATENT DOCUMENTS

| | | | | |
|---|---|---|---|---|
| 631,402 | | 8/1899 | Lewis . | |
| 725,426 | | 4/1903 | Eccleston . | |
| 1,918,285 | | 7/1933 | Offen . | |
| 2,416,580 | * | 2/1947 | Hancock | 242/596.1 |
| 2,620,991 | * | 12/1952 | Deffenbaugh | 242/560.3 |
| 2,809,790 | | 10/1957 | Kirchel . | |
| 2,888,214 | | 5/1959 | Wilke . | |
| 2,896,871 | | 7/1959 | Woodruff . | |
| 2,908,449 | | 10/1959 | Bolger . | |
| 3,245,626 | | 4/1966 | Casteel . | |
| 3,872,692 | | 3/1975 | Miyagawa et al. . | |
| 4,234,136 | | 11/1980 | Wenzel et al. . | |
| 4,522,346 | * | 6/1985 | Jespersen | 242/560.3 |
| 5,000,393 | * | 3/1991 | Madsen | 242/560 |
| 5,597,133 | * | 1/1997 | Teague | 242/560.3 |

* cited by examiner

*Primary Examiner*—John M. Jillions
(74) *Attorney, Agent, or Firm*—Bourque & Associates, P.A.

(57) ABSTRACT

The roll support (10) is used for removably connecting a suspended roll (12) to a housing (14). The support (10) comprises two opposite supporting assemblies (20), each located on a respective side (22,24) of the housing (14). Each assembly (20) comprises a plate member (30) operatively connected to the housing (14) and pivotable around a horizontal pivot axis. A spring (50) forces a surface of the plate member (30) toward the horizontal. A suspension member (60) is pivotally connected to the housing (14) for supporting a respective side of the roll (12). The roll support (10) provides a simple mechanism for removably connecting a suspended roll (12) to a housing (14) without the need of manually inserting a mandrel through the spool (16) of the roll (12). A method for connecting a suspended roll (12) to a housing (14) is also disclosed.

20 Claims, 5 Drawing Sheets

ROLL SUPPORT

BACKGROUND

Conventional roll supports include more or less complicated mechanisms. Some require the use of a removable mandrel that needs to be manually inserted into the spool of the roll before its insertion in a corresponding housing of an apparatus. This complicates the process for the operator and increases the time for the replacement of a roll.

SUMMARY

It is an object of the present invention to provide a simple mechanism to removably connect a suspended roll to a housing without the need of manually inserting a mandrel through the spool of the roll. It is also an object of the present invention to provide a new method for removably connecting a suspended roll to a housing.

The roll is suspended by gravity in the housing from the interior of an opened cylindrical spool around which the rolled up material is provided. The roll is supported in such a way that the rolled up material can be easily unrolled. This invention is particularly well adapted for paper rolls, especially rolls of paper used for issuing lottery tickets. It can also be used in a wide range of other applications, for example to support paper rolls for issuing receipts, and with materials other than paper, including fabrics, tissues, tapes, cords, wires or any other materials that can be rolled up.

More particularly, the present invention relates to a roll support for removably connecting a suspended roll to a housing. The support comprises two opposite supporting assemblies. Each assembly has a plate member that is operatively connected to a respective side of the housing and pivotable around a first horizontal pivot axis. The plate member provides a roll-receiving surface movable between a substantially horizontal position that is above or in the housing, and a substantially vertical position that is within the housing. A first biasing element forces the surface of the plate member toward the substantially horizontal position.

Each assembly comprises a suspension member that is pivotally connected to the respective side of the housing and pivotable around a second horizontal pivot axis. The suspension member has a main longitudinal axis that is orthogonal to the second pivot axis. The suspension member is pivotable relative to the plate member between a first position where the main longitudinal axis is at least parallel to the surface of the plate member, and a second position where the main longitudinal axis is substantially orthogonal to the surface. A second biasing element forces the suspension member toward the second position.

The present invention also provides a roll support comprising two opposite support means. Each support means comprise first means operatively connected to a respective side of the housing for providing a roll-receiving surface. The surface of the first means is movable between a substantially horizontal upper position and a substantially vertical lower position. Second means are used for forcing the surface of the plate means toward the substantially horizontal position. Third means are provided for supporting the weight of a respective side of the roll. The third means have a main longitudinal axis and are pivotable, relative to the first means, between a first position where the main longitudinal axis is at least parallel to the surface of the first means, and a second position where the main longitudinal axis is substantially orthogonal to the surface. Fourth means are provided for forcing the third means against the first means.

The present invention also relates to a method for connecting a suspended roll to a housing. The method is initiated by engaging the cylindrical outer surface of the roll against a middle portion of two opposite plate members that are initially projecting substantially inward from opposite sides of the housing. The roll is then moved into the housing against the action of two opposite biasing elements that force a respective plate member toward their initial position. Finally, the roll is further moved into the housing in order to allow inwardly-biased suspension members, each located on a respective side of the housing, to pivot and penetrate into the opened central spool.

A non-restrictive description of a preferred embodiment will now be given with reference to the appended figures.

IDENTIFICATION OF THE COMPONENTS

Figure 1:
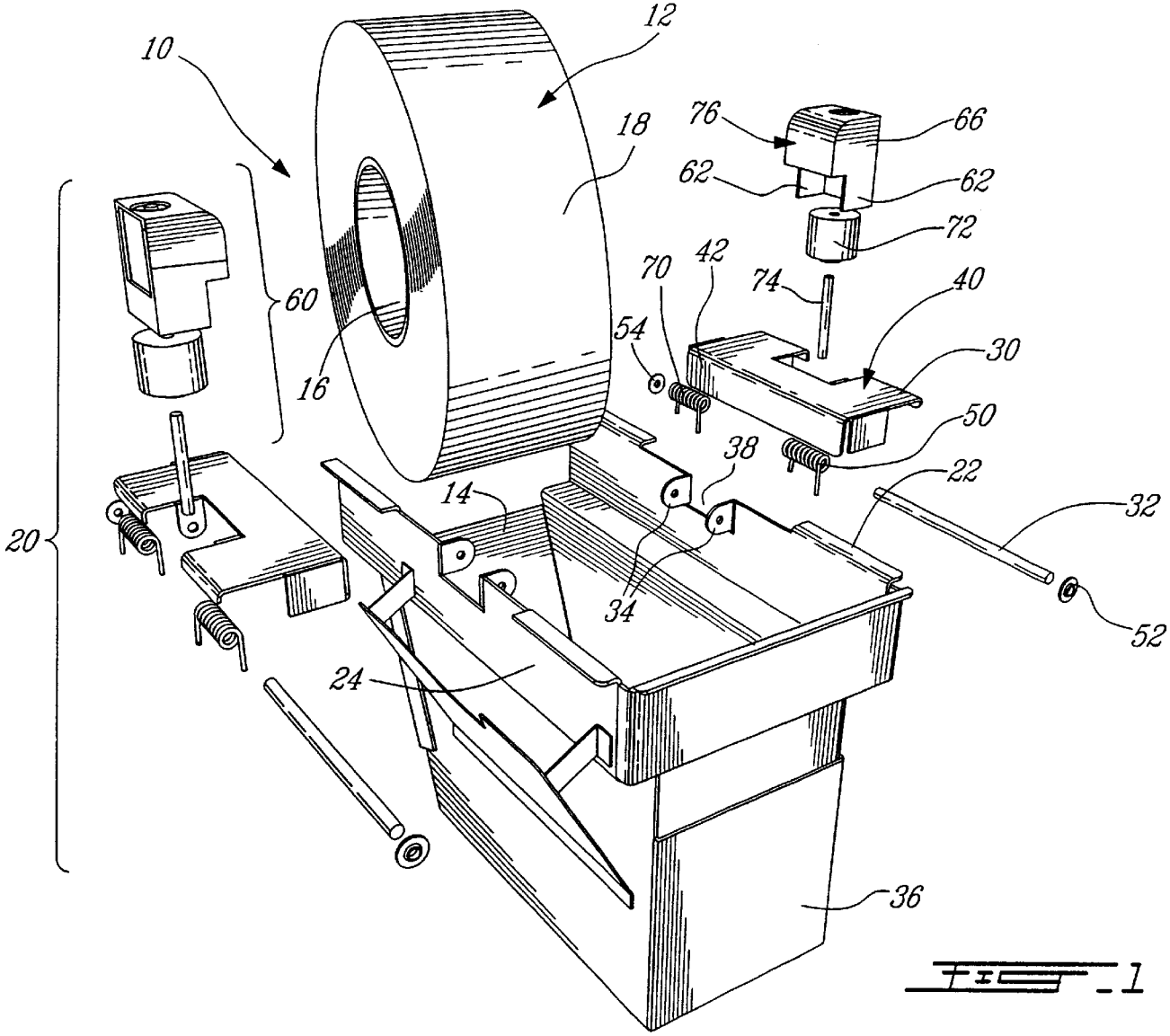
FIG. 1 is an exploded perspective view of a roll support according to a preferred embodiment of the present invention.
Figure 2:
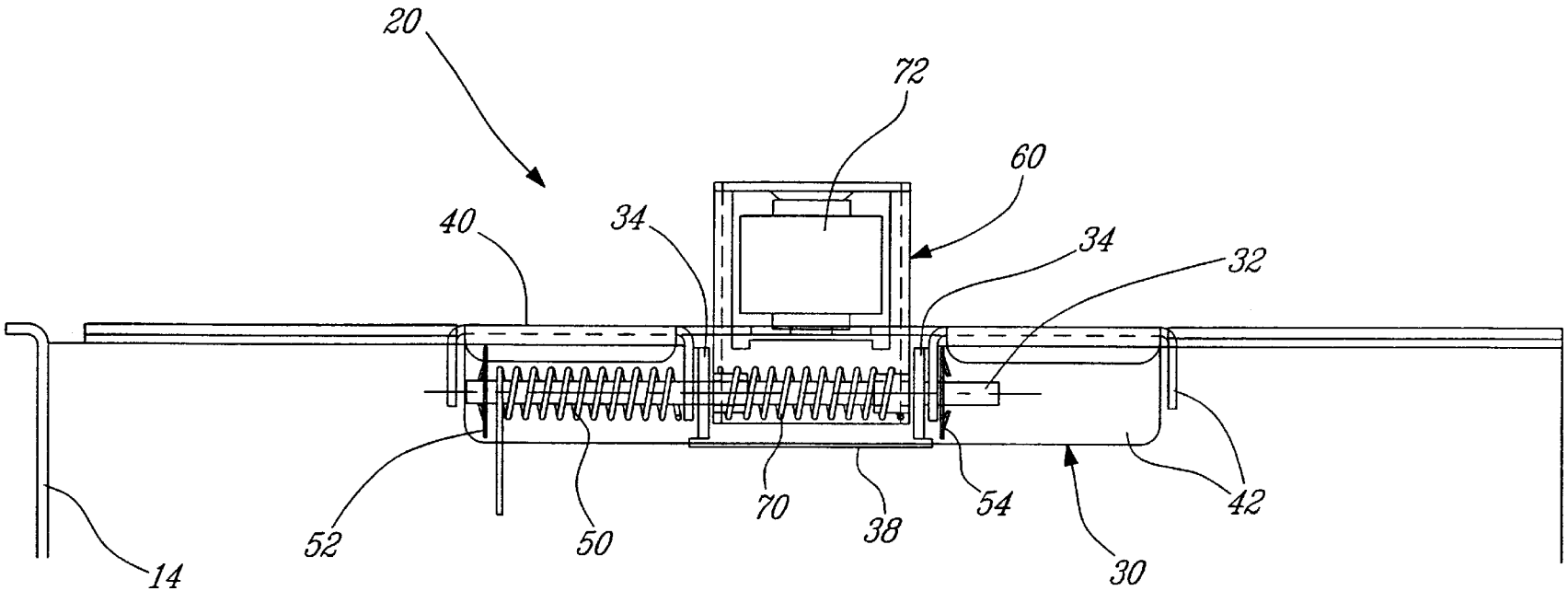
FIG. 2 shows an individual supporting assembly of the support of FIG. 1, when viewed from inside the housing.

The following is a list of the reference numerals, along with the names of the corresponding components, that are used in the appended figures and in the description.

| | |
|---|---|
| 10 | roll support |
| 12 | roll |
| 14 | housing |
| 16 | spool (of the roll) |
| 18 | cylindrical outer surface (of the roll) |
| 20 | supporting assemblies |
| 22 | side (of the housing) |
| 24 | side (of the housing) |
| 30 | plate members |
| 32 | axles |
| 34 | brackets (of the housing) |
| 36 | bottom part (of the housing) |
| 38 | central opening (in each plate member) |
| 40 | roll-receiving surface (on each plate member) |
| 42 | flanges (of each plate member) |
| 50 | first spring |
| 52 | push nuts |
| 54 | push nuts |
| 60 | suspension members |
| 62 | side flanges (of each suspension member) |
| 64 | main longitudinal axis (of each suspension member) |
| 66 | casing (of each suspension member) |
| 70 | second spring |
| 72 | roller (of each suspension member) |
| 74 | pin (for each roller) |
| 76 | rounded interior L-shaped surface (of each suspension member) |

DESCRIPTION

FIG. 1 illustrates a roll support (10) that is designed for removably connecting a suspended paper roll (12) to a corresponding housing (14) located in an apparatus used for issuing lottery tickets. The roll (12) is suspended by gravity from the interior of an opened cylindrical spool (16) around which the paper is rolled up. The roll (12) is supported in such a way that the paper is allowed to be easily unrolled from the periphery of its cylindrical outer surface (18). Although this invention is particularly well adapted for rolls of paper, especiallyose used for issuing lottery tickets, it can also be used in a wide range of other applications, for example to support paper rolls in cash registers or other apparatuses issuing receipts, and with materials other than paper, including fabrics, tissues, tapes, cords, wires or any other materials that can be rolled up.

The spool (16) is usually made of rigid cardboard or plastic. It is said to be opened, which means that there is a central opening which extends from side to side or that the spool (16) has at least two opposite bores, one on each side, that are deep enough for receiving a respective suspension member, as explained later. The opening or the bores are provided with a smooth interior cylindrical surface to allow rotation of the roll (12) once set in the housing (14).

The housing (14) is broadly defined as a casing or a basket, such as the one illustrated in FIG. 1. It is removable or not from the apparatus. It can also be just a mere open space within opposite walls of the apparatus. The housing (14) is accessible by the operator or the maintenance personal for the removal of a roll and the insertion of another one. The free end of the material to be unrolled is then inserted through an appropriate feeding mechanism (not shown) of the apparatus. Yet, the apparatus may be any kind of device or object, from the less sophisticated to the most complex.

The support (10) comprises two opposite and preferably identical supporting assemblies (20). The various parts of each assembly (20) are connected to a respective side (22,24) of the housing (14). The assemblies (20) are said to be opposite, which means that one is substantially a mirror image of the other with reference to a median plane parallel to the direction of insertion of the roll (12) and which is orthogonal to the axis of rotation of the roll (12), once the roll (12) is in place in the housing (14).

Figure 6:
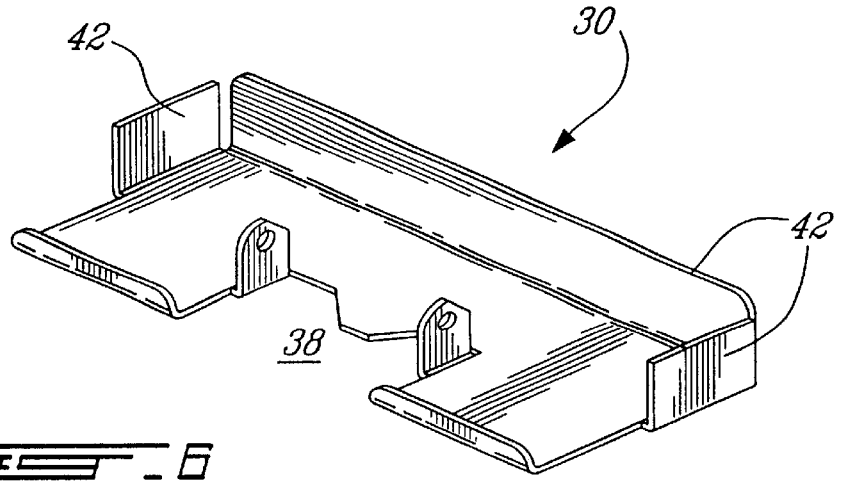
FIG. 6 is a perspective view of one of the plate members shown in FIG. 1.

Each assembly (20) preferably comprises a plate member (30) that is operatively connected to the respective side (22,24) of the housing (14). FIG. 6 shows an example of an individual plate member (30). The plate member (30) is pivotable around a horizontal pivot axis. Preferably, this pivot axis is defined by a horizontally-disposed axle (32) that is connected to two brackets (34) projecting into the housing (14) from the respective side (22,24) thereof. The axle (32) is parallel to the respective side (22,24). In the illustrated embodiment, the sides (22,24) of the housing (14) are slightly outwardly offset with reference to the bottom part (36) thereof. These offsets give room for the assemblies (20) and the brackets (34) since the width of the bottom part (36) of the housing (14) is approximately equivalent to the width of the roll (12).

The main function of the plate member (30) is to provide a roll-receiving surface (40) on which the cylindrical outer surface (18) of the roll (12) is initially engageable during the insertion of the roll (12). Any similar structure providing such surface (40) may be used instead of the plate member (30). The surface (40) of both assemblies (20) will be simultaneously engaged by the cylindrical surface (18) of the roll (12).

Each surface (40) is movable between a substantially horizontal position and a substantially vertical position. The horizontal position is above or in the housing (14), which means that the surface (40) will be in the path of the roll (12) during its insertion. The substantially vertical position is within the housing (14) once the roll (12) is in place. Proper restrictions of the movement within the range of positions can be achieved in numerous ways. In the illustrated embodiment, an edge of each plate member (30) abuts on the upper edge of the respective side (22,24) of the housing (14) when the surface (40) is substantially horizontal. Some of orthogonally-projecting flanges (42) that are provided on each plate member (30) are used to hold it in place against the respective side (22,24) when the surface (40) is in the substantially vertical position.

A first biasing element is used in each assembly (20) for forcing the surface (40) toward the substantially horizontal upper position when there is no roll (12) in the housing (14). Preferably, this first biasing element comprises a first torsion spring (50) mounted around the corresponding axle (32) and connected between the housing (14) and the plate member (30). A push nut (52) is coaxially mounted on the axle (32) to hold both the first spring (50) and the axle (32). An opposite push nut (54) holds the other side of the axle (32). Of course, other kinds of springs and biasing mechanisms can be devised for achieving the same purpose.

Each assembly (20) preferably comprises a suspension member (60) that is also pivotally connected, either directly or through the plate member (30), to the respective side (22,24) of the housing (14). The suspension member (60) is pivotable around a horizontal pivot axis. Preferably, this second pivot axis is in registry with the pivot axis of the plate member (30) and is defined by the axle (32). In the illustrated embodiment, the suspension member (60) comprises a casing (66) connected to the axle (32) by means of two spaced-apart side flanges (62). The adjacent plate member (30) preferably comprises a central opening (38) to accommodate the suspension member (60). This arrangement also allows the suspension member (60) to abut on the surface (40) of the plate member (30) at the second position thereof.

The function of the suspension members (60) is to support the weight of the roll (12), once suspended. Each suspension member (60) comprises a main longitudinal axis (64) that is orthogonal to the pivot axis of the suspension member (60), more particularly the axle (32). The suspension member (60) is pivotable relative to the plate member (30) between a first position where the main longitudinal axis (64) is at least parallel to the surface (40) of the plate member (30), which means that the angle between them is about 180° or more, and a second position where the main longitudinal axis (64) is substantially orthogonal to the surface (40). The bottom of the suspension member (60) preferably abuts against the surface (40) at that moment.

Figure 8:
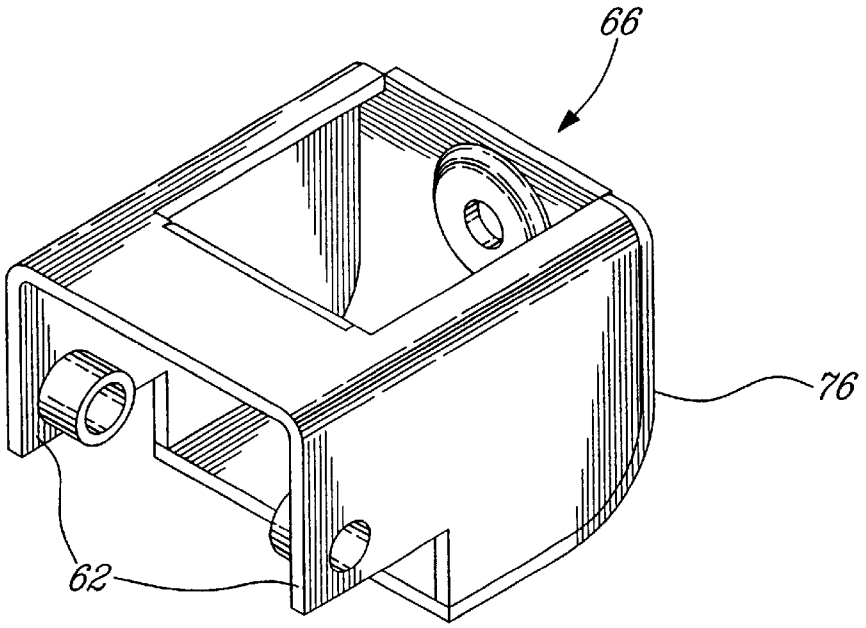
FIG. 8 is a perspective view of the casing of the supporting member shown in FIG. 7.

A second biasing element is used to force the suspension member (60) of each assembly (20) toward its second position. Preferably, the second biasing element comprises a second torsion spring (70) mounted around the corresponding axle (32) and connected between the plate member (30) and the suspension member (60). In the illustrated embodiment, the second spring (70) is mounted between the two side flanges (62) of the suspension member (60), which are best shown in FIG. 8. The second spring (70) allows the suspension member (60) to follow the movement of the plate member (30) from the horizontal to the vertical, unless the sides of the roll (12) prevent the suspension member (60) from temporally moving inward into the housing (14).

Each suspension member (60) further comprises a L-shaped interior surface (76) with a rounded corner. A portion of this surface (76) is to be engaged against the side of the roll (12) during the insertion thereof.

Figure 3:
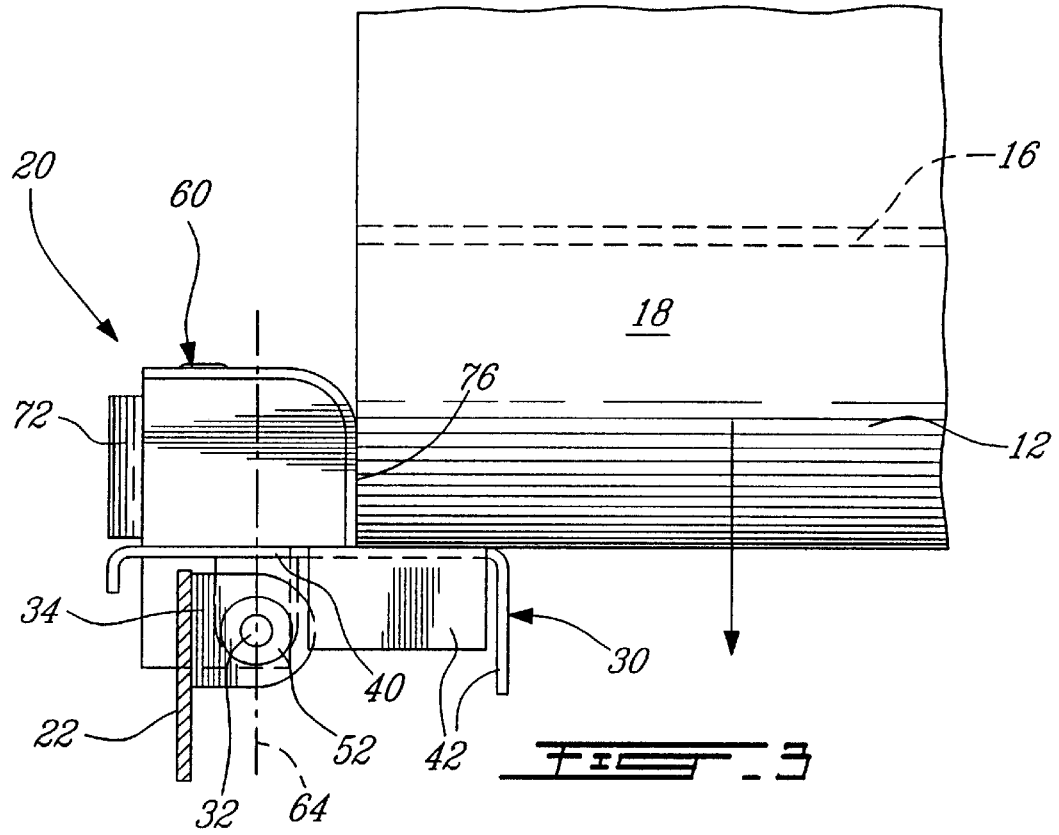
FIG. 3 is a partial front view of an individual supporting assembly, showing a first step of the insertion procedure.

In use, to insert a roll (12) in the support (10), the cylindrical surface (18) of the roll (12) is initially engaged against the middle portion of the plate members (30), as shown in FIG. 3. The surfaces (40) are substantially projecting inward at that moment, which means that they are in the direct path of the roll (12). When the roll (12) is loaded vertically, the surfaces (40) are substantially horizontal. They can have a slight positive or negative angle with the horizontal without affecting the proper operation of the support (10). The roll (12) may also be loaded horizontally or in any other directions, depending on the design of the support (10).

Figure 4:
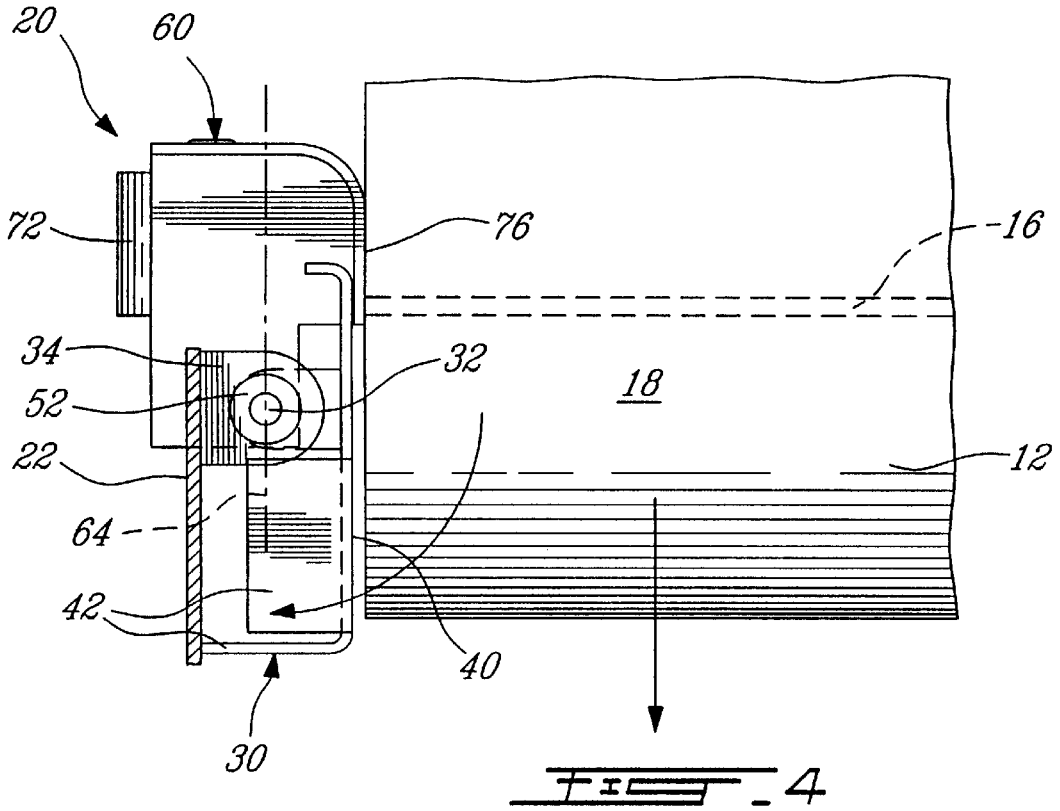
FIG. 4 is a view similar to FIG. 3, showing a second step of the insertion procedure.
Figure 5:
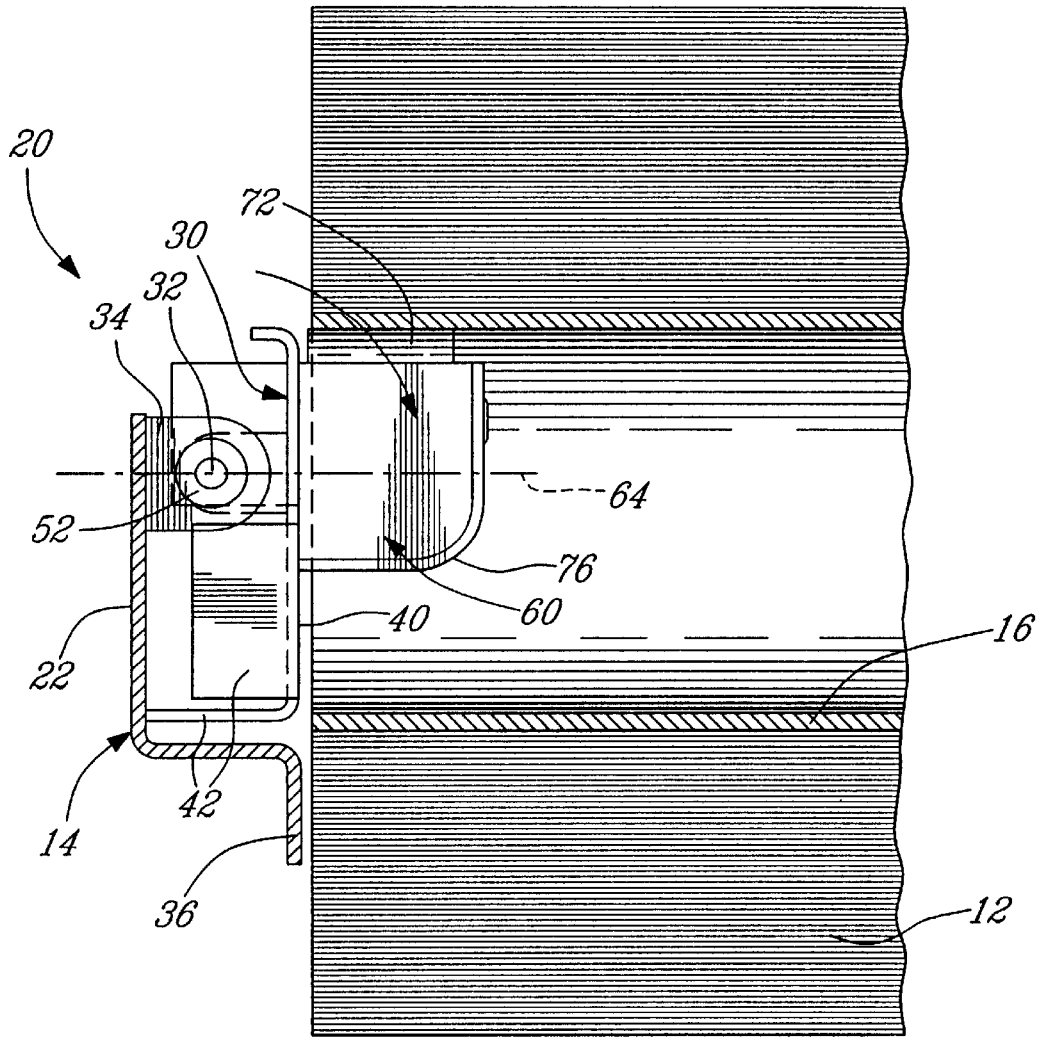
FIG. 5 is a cross-sectional front view of the individual supporting assembly shown in FIGS. 3 and 4, showing a roll suspended therein.

Once engaged on the surfaces (40) of the plate members (30), the roll (12) is moved into the housing (14) against the action of the first spring (50). This movement of the roll (12) is achieved either by manually pushing the roll (12) inward or by the weight of the roll (12) itself, depending on the biasing force, the weight of the roll (12) and the direction of insertion. At that moment, as shown in FIG. 4, the main longitudinal axis (64) of each suspension member (60) is still about at their original position because the suspension members (60) cannot move inward due to the presence of the sides of the roll (12). However, by further moving the roll (12) inward, the suspension members (60) will eventually be in alignment with the opening of the spool (16) and penetrate therein under the action of the second springs (70). The inward movement of the roll (12) then continues until the suspension members (60) be in engagement with the upper side of the central opening of the spool (16). The roll (12) is then suspended, as shown in FIG. 5. The weight of the roll (12) is transmitted to the suspension members (60) and then ultimately to the respective side (22,24) of the housing (14). The main longitudinal axis (64) of each suspension member (60) is perpendicular to the corresponding surface (40) at that moment.

Figure 7:
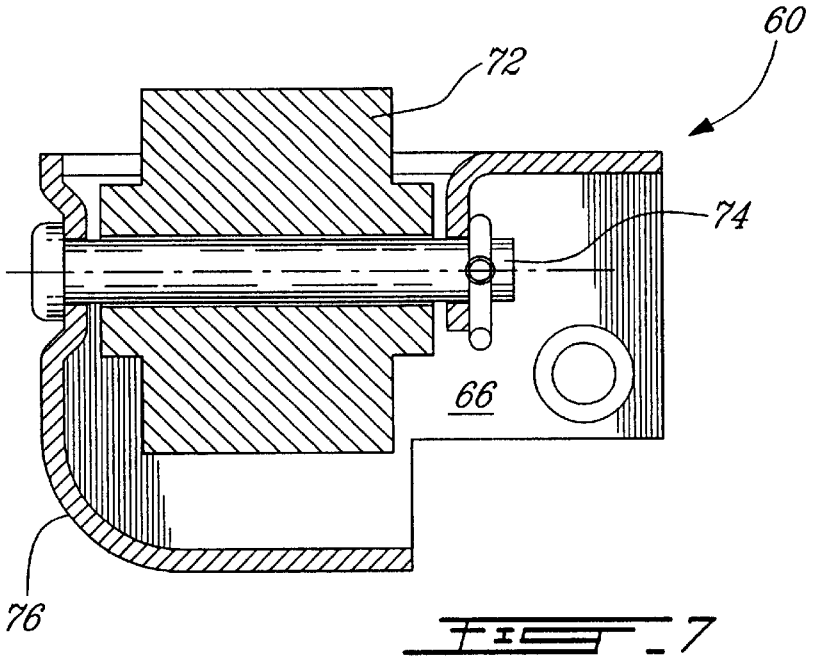
FIG. 7 is a longitudinal cross-sectional view of one of the supporting members shown in FIG. 1.

Preferably, each suspension member (60) comprises a roller (72) having a rotation axis, defined by a pin (74) in the illustrated embodiment, that is parallel to the main longitudinal axis (64) of the suspension member (60). FIG. 7 shows this subassembly. The upper portion of the roller (72) is engageable with the interior surface of the spool (16), once the roll (12) is in place, in order to facilitate the rotation of the roll (12) by lowering the friction to a bare minimum. This roller (72) is preferably made of Nylon or other similar material. Alternatively, the surface of the suspension members (60) may only be provided with a smooth bearing surface (not shown) or any other analogue arrangements.

To remove the roll (12) once empty or for any other reasons, the steps are performed in the reversed order.

Although a preferred embodiment of the invention has been described in detail herein and illustrated in the accompanying figures, it is to be understood that the invention is not limited to this precise embodiment and that various changes and modifications may be effected therein without departing from the scope or spirit of the present invention.

What is claimed is:

1. A roll support for removably connecting a suspended roll to a housing, the roll having an opened cylindrical spool, the support comprising two opposite supporting assemblies, each assembly having:

a plate member operatively connected to a respective side of the housing and pivotable around a first horizontal pivot axis, the plate member providing a roll-receiving surface movable between a substantially horizontal position that is above or in the housing, and a substantially vertical position that is within the housing;

a first biasing element to force the surface of the plate member toward the substantially horizontal position;

a suspension member pivotally connected to the respective side of the housing and pivotable around a second horizontal pivot axis, the suspension member having a main longitudinal axis that is orthogonal to the second pivot axis, the suspension member being pivotable relative to the plate member between a first position where the main longitudinal axis is at least parallel to the surface of the plate member, and a second position where the main longitudinal axis is substantially orthogonal to the surface; and a second biasing element to force the suspension member toward the second position.

2. A roll support according to claim 1, wherein each suspension member comprises a roller having a rotation axis that is parallel to the main longitudinal axis thereof, the upper portion of the roller being engageable with an interior surface of the spool.

3. A roll support according to claim 2, wherein the roller is made of Nylon.

4. A roll support according to claim 1 where each suspension member comprises a rounded interior L-shaped surface.

5. A roll support according to claim 1, wherein the first pivot axis and the second pivot axis of each assembly are registered and defined by a common axle that is substantially parallel to the respective side of the housing.

6. A roll support according to claim 5, wherein the first biasing element of each assembly comprises a torsion spring mounted around the corresponding axle and connected between the housing and the plate member.

7. A roll support according to claim 5, wherein the second biasing element of each assembly comprises a torsion spring mounted around the corresponding axle and connected between the plate member and the suspension member.

8. A roll support according to claim 1, wherein the plate member of each assembly comprises a central opening to accommodate the suspension member, the suspension member abutting on the surface of the plate member at the second position thereof.

9. A roll support according to claim 1, wherein the roll is a paper roll.

10. A roll support according to claim 9, wherein the paper roll is used for issuing lottery tickets.

11. A roll support having two opposite support means for removably connecting a suspended roll to a housing, the roll having an opened cylindrical spool, each support means comprising:

first means operatively connected to a respective side of the housing for providing a roll-receiving surface, the surface of the first means being movable between a substantially horizontal position and a substantially vertical position;

second means for forcing the surface of the first means toward the substantially horizontal position;

third means for supporting the weight of a respective side of the roll, the third means having a main longitudinal axis and being pivotable, relative to the first means, between a first position where the main longitudinal axis is at least parallel to the surface of the first means, and a second position where the main longitudinal axis is substantially orthogonal to the surface; and fourth means for forcing the third means against the first means.

12. A roll support according to claim 11, wherein each third means comprise a roller having a rotation axis that is parallel to the main longitudinal axis thereof, the upper portion of the roller being engageable with an interior surface of the spool.

13. A roll support according to claim 12, wherein the roller is made of Nylon.

14. A roll support according to claim 11, where each third means comprise a rounded interior L-shaped surface.

15. A roll support according to claim 11, wherein the second means of each support means comprise a spring connected between the housing and the first means.

16. A roll support according to claim 11, wherein the fourth means of each support means comprise a spring connected between the first means and the third means.

17. A roll support according to claim 11, wherein the first means of each support means comprise a central opening to accommodate the corresponding third means, the third means abutting on the first means at the second position thereof.

18. A roll support according to claim 11, wherein the roll is a paper roll.

19. A roll support according to claim 18, wherein the paper roll is used for issuing lottery tickets.

20. A method for the bi-directional insertion and removal of a roll, without consideration of whether the roll is empty, into a housing having a roll entry point, said roll having two opposite sides, a cylindrical outer surface and an opened cylindrical spool, wherein said insertion and said removal of said roll into said housing is made at said roll entry point, the method comprising the steps of:

selecting one action from the acts of inserting said roll into said housing and removing said roll from said housing, said act of inserting said roll into said roll entry point of said housing comprising the acts of:

engaging the cylindrical outer surface of the roll against a middle portion of two opposite plate members that are initially projecting substantially inward from opposite sides of the housing;

moving the roll into the housing against the action of two opposite biasing elements that force a respective plate member toward their initial position; and further moving the roll into the housing in order to allow inwardly-biased suspension members, each located on a respective sides of the housing, to pivot and penetrate into the opened cylindrical spool;

the act of removing said roll from said roll entry point of said housing comprising the act of disengaging the cylindrical outer surface of the roll from against the middle portion of said two opposite plate members, said disengagement releasing said inwardly-biased suspension members from said opened cylindrical spool of said roll allowing said spool to be disengaged from said housing through said roll entry point.

* * * * *